US010475294B2

(12) United States Patent
Gomez et al.

(10) Patent No.: US 10,475,294 B2
(45) **Date of Patent: *Nov. 12, 2019**

(54) CASINO GAME WITH PERIPHERAL ARRAY OF SCATTER SYMBOLS AROUND A SET BACK DISPLAY SCREEN DEPICTING MOTOR DRIVEN REELS

(71) Applicant: Gemini Digital Development, Inc., Las Vegas, NV (US)

(72) Inventors: Ben Gomez, Chicago, IL (US); James P. Jackson, Henderson, NV (US); Alfred Thomas, Las Vegas, NV (US)

(73) Assignee: GEMINI DIGITAL DEVELOPMENT, INC., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/026,756

(22) Filed: Jul. 3, 2018

(65) Prior Publication Data

US 2018/0330578 A1 Nov. 15, 2018

Related U.S. Application Data

(63) Continuation-in-part of application No. 14/338,792, filed on Jul. 23, 2014, now Pat. No. 10,043,350.

(60) Provisional application No. 61/857,577, filed on Jul. 23, 2013.

(51) Int. Cl.
*G07F 17/32* (2006.01)
*G07F 17/34* (2006.01)

(52) U.S. Cl.
CPC ..... *G07F 17/34* (2013.01); *G07F 17/3213* (2013.01); *G07F 17/3267* (2013.01)

(58) Field of Classification Search
CPC ... G07F 17/34; G07F 17/3213; G07F 17/3267
See application file for complete search history.

(56) References Cited

U.S. PATENT DOCUMENTS

| | | | |
|---|---|---|---|
| 4,732,386 | A | 3/1988 | Rayfiel |
| 5,152,529 | A | 10/1992 | Okada |
| 5,205,555 | A | 4/1993 | Hamano |
| 5,722,891 | A | 3/1998 | Inoue |
| 5,752,881 | A | 5/1998 | Inoue |

(Continued)

*Primary Examiner* — David L Lewis
*Assistant Examiner* — Matthew D Hoel
(74) *Attorney, Agent, or Firm* — Patent Law Group LLP; Brian D. Ogonowsky

(57) ABSTRACT

A gaming machine displays a set of virtual center reels, creating an M×N array of symbols, and an independent set of virtual peripheral reels surrounding the M×N array. The peripheral reels are part of a secondary game, and each peripheral reel displays only one symbol position. The center reels contain at least one trigger symbol for trigging the secondary game. The center reels are displayed on a separate, set-back display to give the illusion of motorized mechanical reels. Awards are granted for winning symbol combinations on the center reels. If the trigger condition exists, a bonus award is granted for winning symbol combinations on the peripheral reels. The bonus award may be based on the number of peripheral symbols that match the displayed trigger symbol or may be based on other criteria. In one embodiment, the trigger symbols are only on one of the center reels.

11 Claims, 5 Drawing Sheets

(56) References Cited

U.S. PATENT DOCUMENTS 5,848,932 A 12/1998 Adams
5,882,261 A 3/1999 Adams
5,911,418 A 6/1999 Adams
6,162,121 A 12/2000 Morro et al.
6,186,894 B1 2/2001 Mayeroff
6,224,484 B1 5/2001 Okuda et al.
6,227,971 B1 5/2001 Weiss
6,375,570 B1 4/2002 Poole
6,702,675 B2 3/2004 Poole et al.
6,832,957 B2 12/2004 Falconer
6,896,617 B2 5/2005 Daly
7,371,170 B2 5/2008 Cregan et al.
7,452,276 B2 * 11/2008 Loose ..... G07F 17/3202 463/20
7,488,252 B2 * 2/2009 Griswold ..... G07F 17/3202 273/138.2
7,578,735 B2 8/2009 Frizzell et al.
7,654,899 B2 * 2/2010 Durham ..... G07F 17/3202 312/7.2
7,744,460 B2 * 6/2010 Walker ..... G07F 17/34 463/16
8,375,033 B2 * 2/2013 Shpigel ..... G06F 17/271 704/9
8,388,432 B2 * 3/2013 Mattice ..... G07F 17/323 313/506
9,011,233 B2 4/2015 Ryan
9,098,847 B2 * 8/2015 Basallo ..... G07F 17/3267
9,098,973 B2 8/2015 Basallo et al.
9,177,447 B2 11/2015 Zoltewicz et al.
9,202,345 B2 12/2015 Zoltewicz et al.
9,430,900 B2 8/2016 Zoltewicz et al.
9,466,169 B2 10/2016 Basallo et al.
9,495,839 B2 11/2016 Aoki et al.
9,595,157 B2 * 3/2017 Rasmussen ..... G07F 17/3211
9,633,506 B2 4/2017 Basallo et al.
2004/0012145 A1 1/2004 Inoue
2005/0130731 A1 6/2005 Englman et al.
2006/0142080 A1 * 6/2006 Enzminger ..... G07F 17/3211 463/30
2008/0108422 A1 * 5/2008 Hedrick ..... G07F 17/34 463/22
2008/0182647 A1 * 7/2008 Brunet De Courssou ..... G07F 17/3211 463/20
2009/0036208 A1 * 2/2009 Pennington ..... G07F 17/3202 463/33
2009/0181755 A1 * 7/2009 Gagner ..... G07F 17/3202 463/20
2011/0300937 A1 * 12/2011 Crowder, Jr. ..... G07F 17/3202 463/34
2012/0220360 A1 * 8/2012 Kelly ..... G07F 17/3202 463/20

* cited by examiner

CASINO GAME WITH PERIPHERAL ARRAY OF SCATTER SYMBOLS AROUND A SET BACK DISPLAY SCREEN DEPICTING MOTOR DRIVEN REELS

CROSS-REFERENCE TO RELATED APPLICATIONS

This application is a continuation-in-part of U.S. patent application Ser. No. 14/338,792, filed Jul. 23, 2014, which claimed priority to U.S. provisional application Ser. No. 61/857,577, filed on Jul. 23, 2013, assigned to the present assignee.

FIELD OF THE INVENTION

This invention relates to gaming devices, such as video slot machines, and, in particular, to a secondary game where randomly selected scatter symbols surround a center reel array.

BACKGROUND

Conventional reel-type video slot machines accept the player's bet of credits, initiate the spinning of virtual reels, randomly stop the reels to display a final array of symbols, then grant an award to a player based on the occurrence of winning symbol combinations across paylines and based on the player's initial bet per payline.

It would be more interesting for the player if an additional secondary game were also played. Ideally, the secondary game would have the potential of awarding very high awards, yet would have a high win frequency for lower value awards. The secondary game should also not take too much time to play and be simple to understand.

SUMMARY

In one example, a video gaming machine displays five center reels with three displayed symbols per reel, forming a 5×3 matrix of symbols. There may be 25 or more different paylines across the five reels. Surrounding the five center reels are independently spun peripheral scatter symbol reels. Scatter symbols can form winning combinations irrespective of their positions. To form a ring of scatter symbols around the center 5×3 matrix of symbols, where all the symbols are of the same size, 20 peripheral reels are needed. In one embodiment, there are about ten different symbols on the center reels and only three different-type scatter symbols on the peripheral reels. Blanks may also be added to the peripheral reels.

Most of the symbols on the center reels are conventional symbols that are used to create winning combinations across paylines. At least some of the center reels also include trigger symbols that trigger the secondary game involving the peripheral reels. In one embodiment, the secondary game is triggered by the display of only a single trigger symbol on the center reels. The trigger symbols may also be wild symbols for creating winning symbols combinations on the center reels.

To enhance the player's excitement, the center reels are stopped first so the player can see whether a trigger condition has occurred. Then the peripheral reels are sequentially stopped so the player can focus on the secondary game.

In one embodiment, there are multiple trigger symbol types, such as three types. Each trigger symbol type directly corresponds with a particular type of scatter symbol that can be displayed by the peripheral reels. In one embodiment, each type of trigger symbol is identical to a corresponding scatter symbol on the peripheral reels.

If a trigger symbol of a certain type is displayed on the center reels in the main game, and after an award is granted for the main game, all the same type scatter symbols displayed by the peripheral reels are highlighted, and a bonus award is granted based on how many of that type of scatter symbol is displayed by the peripheral reels.

In one embodiment, all the trigger symbols are only included on the fifth (rightmost) reel, and only one trigger symbol can be displayed at a time. There is at least one type of trigger symbol for each type of scatter symbol on the peripheral reels.

In one embodiment, if multiple different trigger symbols are displayed, two bonus awards are granted, one for each scatter symbol type displayed by the peripheral reels. If two of the same type of trigger symbols is displayed, the bonus award is doubled or otherwise multiplied.

In one embodiment, the image of the trigger symbols is unrelated to the image of the scatter symbols. In that embodiment, a certain combination of the trigger symbols on the center reels triggers the secondary game. The bonus award is based on winning combinations of the scatter symbols on the peripheral reels, in accordance with a displayed paytable.

The scatter symbols may include high value scatter symbols or all equal value scatter symbols. The bonus award may increase non-linearly with the number of matching scatter symbols so that there is a possibility of a very high bonus award. The different trigger symbols and scatter symbols may have different probabilities of occurring (weighted probabilities). As seen, there is a wide range of possibilities in designing the reel strips for the center reels and the peripheral reels which allow the designer to provide for a high bonus win frequency when a trigger symbol is displayed, yet also provide for a low frequency of very high bonus awards. If blanks are also included on the scatter reels, the design flexibility is further increased.

If the secondary game results in no bonus win, a consolation award may be granted.

In another embodiment, after a triggering event, the occurrence of a certain number of the same scatter symbols triggers another bonus game, which may be an interactive game where the player picks certain icons with hidden awards or any other type of special bonus game.

Many different types of games may use the concept of a ring of "single symbol" peripheral reels surrounding conventional center reels, where each peripheral reel is independently spun and stopped, and any bonus award is based on the scatter symbols displayed by the peripheral reels. The secondary game takes very little time to play since it is run concurrently with the main game, and the game is easy to understand.

The game may also be implemented with motorized physical reels as the center reels and/or the peripheral reels. In one embodiment, the center reels are physical reels and the peripheral reels are displayed on one or more display screens.

In another embodiment, motorized center reels are depicted as a 3-dimensional image, or an image that has actual depth, on a special center display, surrounded by a flat display showing the peripheral reels. This clearly distinguishes the center reels from the peripheral reels. In a conventional gaming machine that uses actual physical reels, only a small portion of the reels is shown through a window of the gaming machine to only display a few symbols on each reel, so the 3-dimensional display of the center reels just needs to convey a slight depth or arc to give the illusion that the center reels are physical reels rather than animated reels.

The flat display showing the peripheral reels may have a transparent center area through which the 3-dimensional center display is viewed in order for the gaming machine to have a planar front surface. The screen showing the image of the motorized center reels is set back to give the illusion that the center reels are motor driven.

In one embodiment, the center display comprises a front flat LCD or OLED screen that is transparent and a rear flat LCD or OLED screen behind the front screen. The two screens display different aspects of an image, including motor driven reels, to give the display of the center reels depth. The center reels may have an animated lighting effect that emulates the lighting generated by, or reflected off of, physical reels.

In another embodiment, the center display that displays the image of the motor driven center reels is actually curved to emulate the curve of a physical reel. A large flat screen displaying the peripheral reels may have a center transparent area through which the set-back curved screen is viewed. Since the center screen is set back and curved, the user sees the center reels as having depth.

In another embodiment, the flat screen that displays the peripheral reels has separate transparent windows for each of the center reels, such as five windows. The center display showing the center reels is then set back from the front display of the peripheral reels to give a 3-dimensional effect so the center reels look like actual mechanical reels.

Other variations are described.

The game applies equally to stand-alone gaming machines in a casino, on-line games using a home computer, and games played on portable devices (e.g., smartphones).

BRIEF DESCRIPTION OF THE DRAWINGS

Elements that are the same or equivalent in the various figures are identified with the same numeral.

DETAILED DESCRIPTION

Although the invention can typically be implemented by installing a software program in most types of modern video gaming machines, one particular gaming machine platform will be described in detail.

Figure 1:
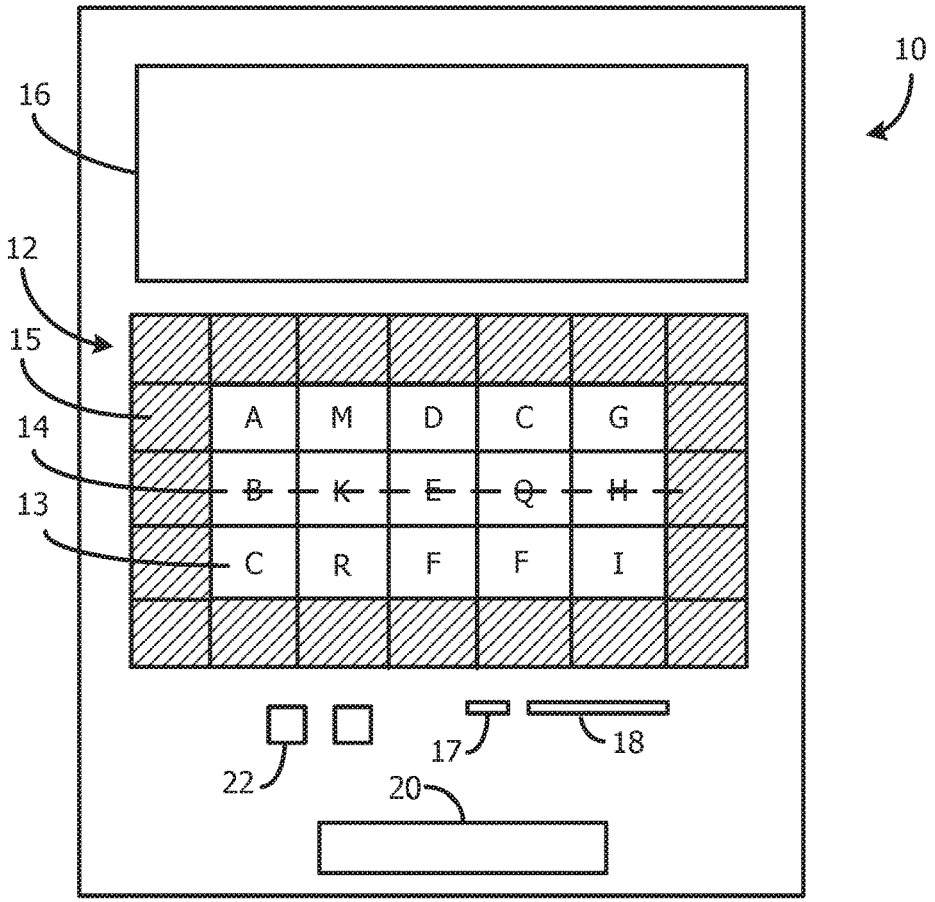
FIG. 1 illustrates a gaming machine that displays a reel-type game on a video screen and is programmed to perform the inventive secondary game.

FIG. 1 illustrates a video gaming machine 10 that incorporates the present invention. The machine 10 includes a bottom display 12 that may be any flat panel color display or any other type of display. In the example shown, the main game shown on the display 12 is the random selection of a 5×3 array of symbols on five virtual reels 13, where an award is granted based on the combination of symbols across any number of paylines, such as the payline 14. The array of symbols may also be a 5×4 array of symbols, a 3×3 array of symbols, or any other size or shape array.

The display 12 also shows a secondary game employing 20 independently spun peripheral reels 15 (or secondary reels), shown cross-hatched. The 20 reels 15 surround the main game reels 13. The symbols displayed on the reels 15 are all scatter symbols since there is no payline associated with winning combinations of symbols on the reels 15. Surrounding the main game with the ring of "single symbol" reels 15 is an effective and efficient way of displaying the secondary game, since the scatter symbols are easy to comprehend by the player and there needs to be no transition to another game motif to play the secondary game. The secondary game is essentially played concurrently with the main game, so the betting frequency is not significantly slowed by the secondary game.

There may be any number of the peripheral reels 15, but the arrangement shown in the figures is the most aesthetically pleasing, and providing 20 reels 15 offers a wide range of symbol selection probabilities in the secondary game.

A top display 16 is an optional video screen that may display a bonus game, or the paytable, or the game's theme, or any other information. The display 16 may instead be backlit painted glass. The top display 16 may also be an extension of the display 12.

A coin slot 17 accepts coins or tokens in one or more denominations to generate credits within the machine 10 for playing games. An input slot 18 accepts various denominations of banknotes or machine-readable tickets, and may output printed tickets for use in cashless gaming. A coin tray 20 receives coins or tokens from a hopper upon a win or upon the player cashing out. Player control buttons 22 include any buttons needed for the play of the particular game or games offered by machine 10 including, for example, a bet button, a spin reels button, a cash-out button, and any other suitable button. Buttons 22 may be virtual touch screen buttons.

In the below scenario, it is assumed that the software program for playing the inventive game is installed in a standalone gaming machine. However, the program may be downloaded to any processing device using a display screen for playing the game. The credits bet may represent a monetary amount (such as for a casino game) or a non-monetary amount (such as where the game is played solely for amusement), and any award may represent a monetary amount or a non-monetary amount.

Figure 2:
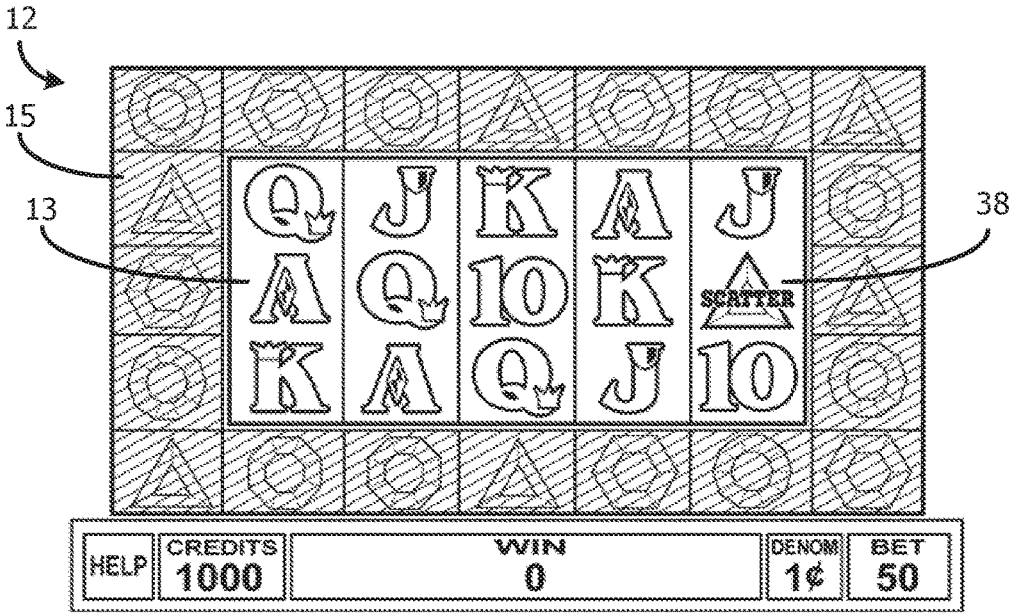
FIG. 2 is a simulated screen shot after five center reels and 20 peripheral reels have been randomly stopped.
Figure 3:
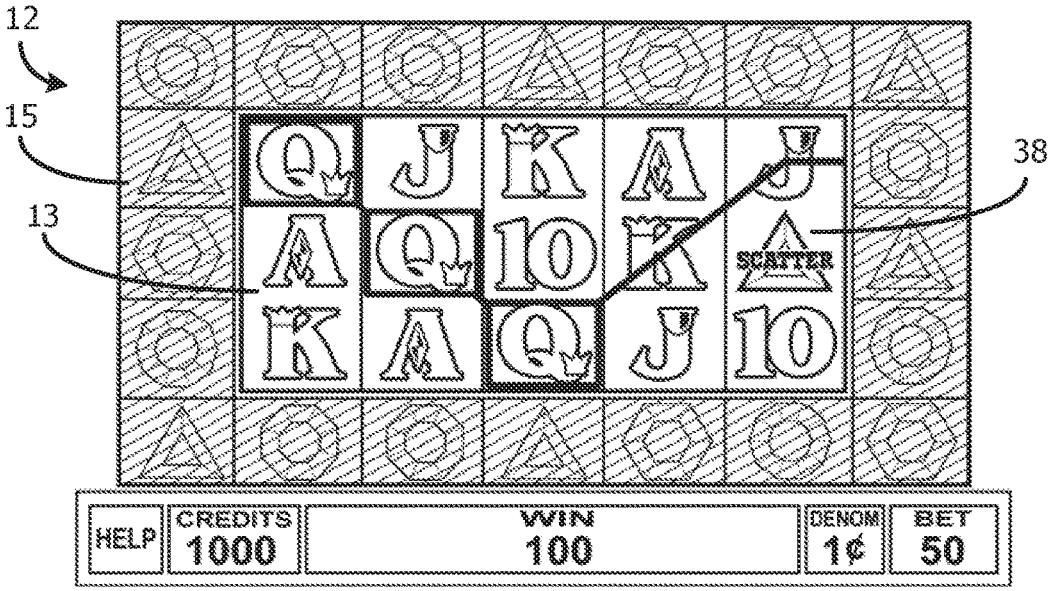
FIG. 3 illustrates a winning symbol combination in the center reels being highlighted and an award granted for the winning symbol combination.
Figure 4:
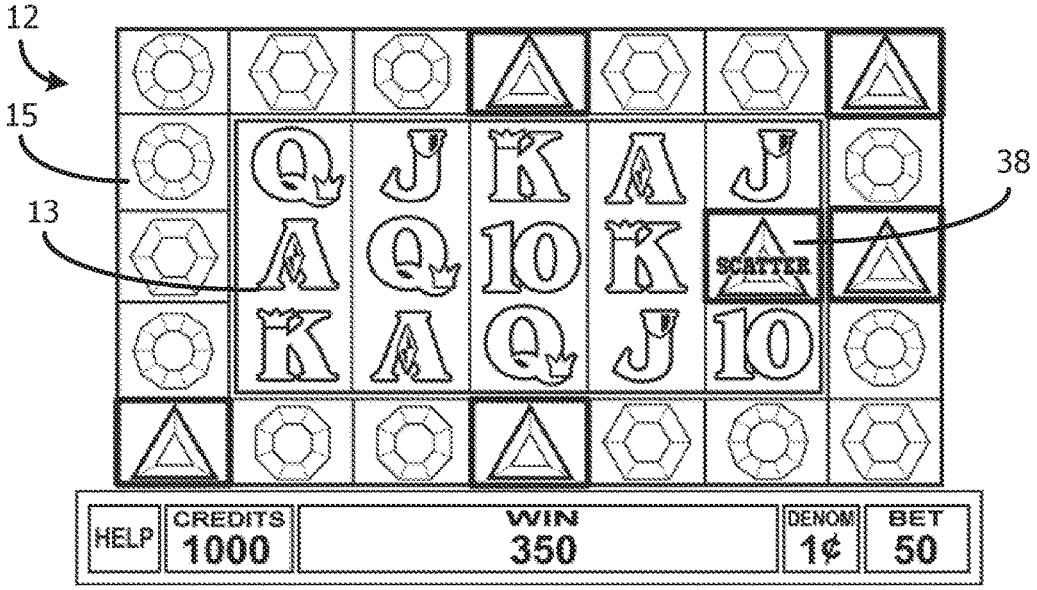
FIG. 4 illustrates how the occurrence of a trigger symbol in the center array of symbols caused the peripheral reels to be highlighted and relevant scatter symbols being identified for granting a bonus award.

FIGS. 2-4 show more detailed images displayed on the display 12 for a single game. The description of the game will also reference the flowchart of FIG. 5.

Figure 5:
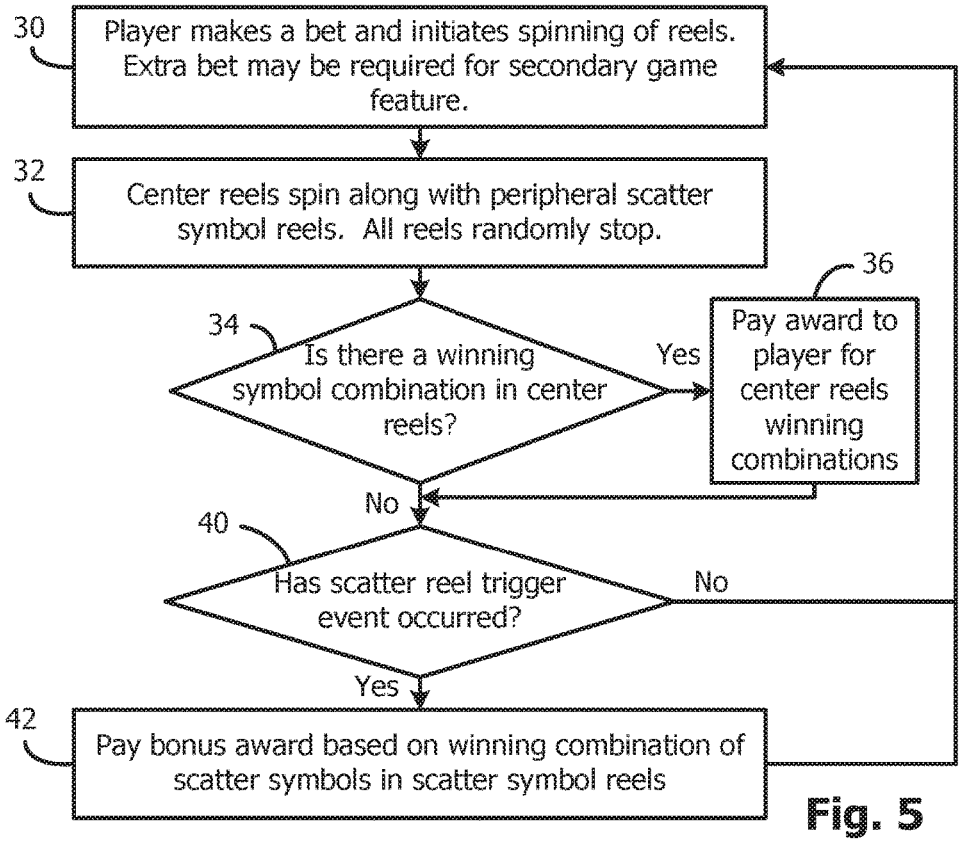
FIG. 5 is a flowchart identifying various steps performed in accordance with an embodiment of the invention.

In step 30 of FIG. 5, the player makes a bet. FIG. 2 illustrates that the player has a bank of 1000 credits and has made a bet of 50 credits (two cents per payline). In one embodiment, the player has to make a special added bet to activate the secondary game. This added bet may be used to fund the secondary game if the paytable for the main game is to be unaffected by the addition of the secondary game.

In step 32, the player then presses a button to simultaneously spin all the center reels 13 and all the peripheral reels 15. A pseudo-random number generator in the gaming machine 10, which may be a subroutine running on the machine's CPU, determines the stopping position of each of the center reels 13 and each of the peripheral reels 15. A software routine animates the reels spinning and stops the reels in sequence starting from the leftmost one of the center reels 13. The peripheral reels 15 are then stopped in sequence starting from the top left peripheral reel and going around the ring so the player can better focus on the unfolding secondary game.

The resulting stopped display is shown in FIG. 2. In FIG. 2, the peripheral reels 15 are darkened to focus attention on the center reels 13. In an actual embodiment, this may not be the case, and the scatter symbols are the type that are very distinguishable from the symbols on the center reels 13 to easily distinguish the two types of symbols. In FIG. 2, the scatter symbols have a gem theme, while the center symbols have a playing card theme.

The award for the center array of symbols is first determined.

In step 34, the CPU determines if there is a winning combination of symbols on the center reels 13 in the 5×3 array.

FIG. 3 illustrates that there is a winning combination of symbols (three Queens) along the illustrated payline.

In step 36, the player is granted an award for the three Queens based on a paytable. Note that there is a secondary game trigger symbol 38 that was displayed on the rightmost center reel 13. This trigger symbol 38 (having a gem theme) acts as a wild symbol for symbols on the same payline, but no winning combinations occurred using the wild symbol in the example. FIG. 3 illustrates that the player has been awarded 100 credits for the three Queens.

In step 40, it is determined by the CPU whether there is a trigger condition for playing the secondary game. In the embodiment shown, there are only trigger symbols 38 on the rightmost reel 13 so that only one trigger symbol 38 at a time can appear on the display 12. However, in other embodiments, the trigger symbols for the secondary game are on multiple reels, and the trigger condition may be the display of three or more trigger symbols 38. In another embodiment, the occurrences of trigger symbols 38 may be saved from game to game, and the secondary game is only triggered when a sufficient number of trigger symbols 38 have been accumulated. Other variations of the trigger condition are contemplated.

Since, in step 40, it has been determined that the trigger condition exists, attention is now drawn to the peripheral reels 15. This may be done with an animation. In the example, there are three possible scatter symbols, a circular gem, a hexagonal gem, and a triangular gem. The trigger symbols on the rightmost reel 13 also include a circular gem, a hexagonal gem, and a triangular gem. When one of the trigger symbol types 38 is displayed on the center reels 13, the same type gem symbols are highlighted on the peripheral reels 15. In the example, the trigger symbol 38 is a triangular gem symbol, and five triangular gem symbols are highlighted on the peripheral reels 15.

There is a paytable for the secondary game that associates the number of highlighted symbols with a particular award. The more highlighted symbols, the greater the award. Therefore, after the player initially sees the triangular gem trigger symbol 38 appear followed by the sequential stopping of the peripheral reels 15, the player is able to see the significance of the various reels 15 stopping on a triangular gem symbol. This order of stopping the various reels 13 and 15 maximizes player excitement since the player already knows the importance of achieving a particular scatter symbol.

In one embodiment, all the scatter symbols have the same value and there is no weighting of the scatter symbol pseudo-random selection. Similarly, the different trigger symbols have equal probabilities of occurring. In another embodiment, however, some scatter symbols are more valuable than others and the probabilities of the display of certain trigger symbols or the scatter symbols are weighted, such as by the arrangements of the various symbols on the reel strips.

In the example shown, each peripheral reel 15 has an equal number of each type of gem symbol on its reel strip. In another embodiment, there may also be blank symbol positions on the peripheral 15 that have no value.

In step 42, the player is granted an award for winning combinations of scatter symbols on the peripheral reels 15. Since there is no payline for the secondary game, the symbols are referred to as scatter symbols. FIG. 4 illustrates that the player was granted a bonus win of 250 extra credits for the five triangular gem symbols on the peripheral reels 15. There may be a minimum number of the same type of scatter symbol needed for a winning combination of scatter symbols.

The game then ends, and the flowchart goes back to step 30.

The concept of peripheral reels 15 surrounding a main game may be applied to any main game, where the main game triggers a secondary game involving the scatter symbols on the peripheral reels 15.

In another embodiment, trigger symbols are on multiple ones of the center reels 13, and the trigger symbols only serve to trigger the secondary game. For example, if three trigger symbols are obtained in the main game, the secondary game is played. The trigger symbols may be wild symbols for the main game. In this embodiment, the trigger symbols do not identify the relevance of any particular scatter symbol. The combinations of the various types of scatter symbols on the peripheral reels 15 are then cross-referenced to a paytable to identify a bonus award. In such an embodiment, the pseudo-random selection of the scatter symbols may be weighted so that higher value symbols are displayed less often.

In another embodiment, multiple center reels 13 have different trigger symbol types, and the display of each type of trigger symbol causes the secondary game to grant awards based on the same symbol types occurring in the peripheral reels 15. For example, the center reels 13 may display a triangular gem symbol and circular gem symbol. In such a case, the bonus award can be based on the number of triangular gem symbols and circular gem symbols occurring on the peripheral reels 15.

In another embodiment, there may be one or more trigger symbols on one of the center reels 13, such as the fifth reel, and the display of the trigger symbol results in the combination of symbols on the peripheral reels 15 being evaluated in any way by a paytable for determining the bonus award. The paytable may be similar to the paytable for the main game, but with different symbols, where different combinations of the different gem symbols are associated with different awards.

In another embodiment, the peripheral reels 15 only have blank positions and the same scatter symbol type, such as a single gem symbol. When a trigger condition occurs in the main game, the number of displayed scatter symbols determines the bonus award.

Man other variations are contemplated.

If there are no winning scatter symbol combinations, the player may be granted a consolation prize.

In another embodiment, a particular combination of the scatter symbols triggers another bonus game, such as a player-selection type game with a potentially high award. One such bonus game may present the player with an array of icons with hidden award values or award multipliers, and the player touches the icon(s) until the game is terminated. Any other bonus game is contemplated.

Figure 6:
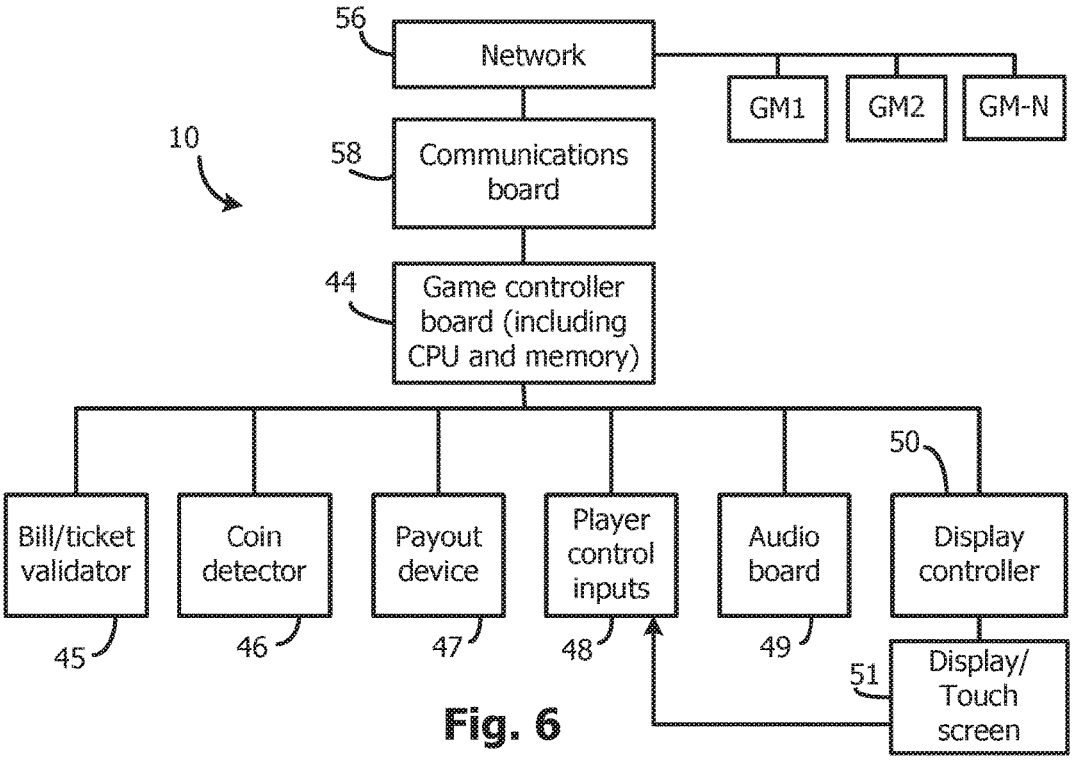
FIG. 6 is a block diagram of certain functional components in the programmed gaming machine of FIG. 1 and illustrates a network connected to linked gaming machines.

FIG. 6 illustrates basic circuit blocks in the machine 10 of FIG. 1. A game controller board 44 includes a processor (CPU) that runs the gaming program (including the secondary game) stored in a program ROM, such as a CD. The program ROM may include a pseudo-random number generator program for selecting symbols and for making other random selections. At least the active portion of the program is stored in a RAM on the board 44 for access by the processor. A pay table ROM on the board 44 detects the outcome of the game and identifies awards to be paid to the player. A bill/ticket validator 45 and coin detector 46 add credits for playing games. A payout device 47 pays out an award to the player in the form of coins or a printed ticket at the end of a game or upon the player cashing out. Player control inputs 48 receive push-button or touch-screen inputs for playing the game. An audio board 49 sends signals to the speakers. A display controller 50 receives commands from the processor and generates signals for the various displays 51. The touch screen portion of the displays 51 provides player selection signals to the processor.

The game controller board 44 transmits and receives signals to and from a network 56 via a communications board 58. The network 56 includes servers and other devices that monitor the linked gaming machines 10 and GM1-GM-N and provide communications between the machines 10 and GM1-GM-N.

The present invention may also be applied to a slot machine having physical, motorized reels in the center area, where the surrounding array of scatter symbols is either displayed on one or more video screens or is composed of physical reels themselves. The resulting display area will still resemble that of FIG. 2.

FIGS. 7-11 are directed to using separate displays for an image of center mechanical reels and an image of the peripheral reels. The image of the mechanical reels is provided on a display that is set back from the display of the peripheral reels to convey depth so as to roughly create the illusion of actual mechanical reels. Note that, although mechanical reels are round, only a small portion of the reels needs to be visible to a player. Thus, the illusion of only a small arc is needed to covey mechanical reels. This may be enhanced using an animated lighting effect in the set-back display.

Although the examples show only three reels for simplicity, any number of reels may be employed, such as five, and any number of vertical symbols may be shown on a reel, such as up to five.

Figure 7:
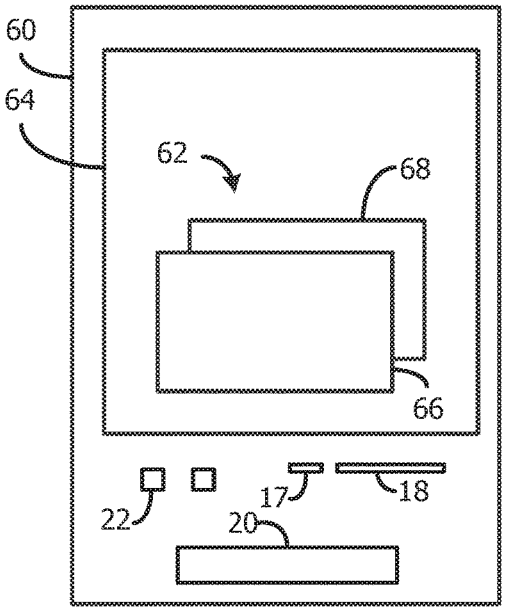
FIG. 7 illustrates a gaming machine with a center display and a separate peripheral display, where the center display comprises two LCD or OLED screens depicting different images to give the center display depth to emulate physical center reels.

FIG. 7 illustrates a gaming machine 60 with a center display 62 and a separate peripheral reel display 64, where the center display 60 comprises a transparent front screen 66 (LCD or OLED) and a rear screen 68. If the screens 66/68 are LCDs, they share the same backlight. The two screens 66/68 depict different images to give the center display depth to emulate mechanical center reels. As an example, the set-back rear screen 68 may display the center reels with a realistic lighting effect to make the reels appear to have an arc. The front screen 66 may display pay lines across the reels, framing, and/or other information. Also shown are the various slots, etc. described with respect to FIGS. 1 and 6. The routine performed by the gaming machine's processor may be the same as described with respect to FIG. 5 and the other embodiments.

Figure 8:
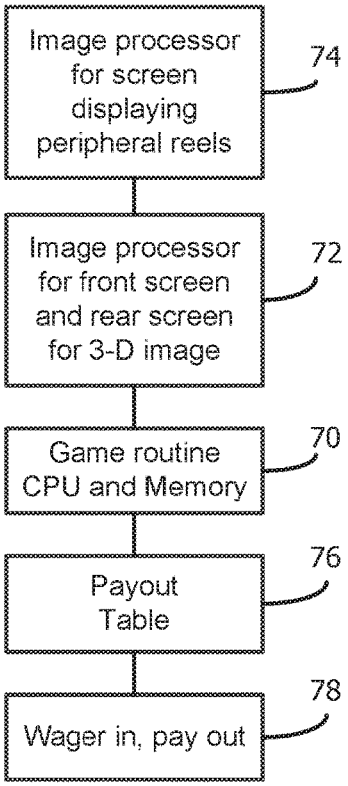
FIG. 8 illustrates certain functional units in the gaming machine of FIG. 7.

FIG. 8 illustrates certain functional units in the gaming machine of FIG. 7. A game routine CPU and memory 70 run the game software. A first image processor 72 processes the different image signals for the front and rear screens 66/68 for the center reels, and a second image processor 74 processes the image signals for the separate peripheral display 64. In one embodiment, the center reel display and the peripheral reel display are independently controlled, based on signals from the game routing CPU, since the two displays may have different operating requirements. A payout table memory 76 determines the player's winnings after a game, and a wager in/pay out system 78 detects the wagers and provides the pay outs to the player.

Figure 9:
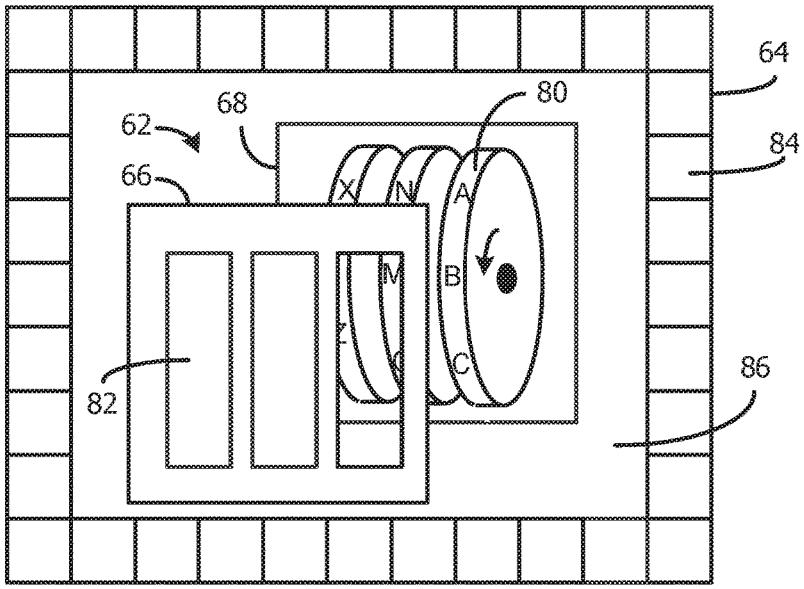
FIG. 9 is an example of the two screens displaying the center reels to convey depth to the player, where a separate large flat screen for the peripheral reels surrounds the center display.

FIG. 9 is an example of the two screens 66/68 in FIG. 7 displaying the center reels 80 (to emulate mechanical reels) on the rear screen 68, with suitable animated lighting effects, and displaying windows 82 on the front screen 66. The rear screen 80 may be set back some distance, such as an inch or more, to emulate the placement of physical reels in a conventional "stepper" gaming machine. Since the front screen 66 is transparent where the "off"-pixels are, the image displayed on the front screen 66 can emulate windows typically formed by painted glass in a conventional stepper machine.

A separate, large flat peripheral reel display 64 conveys the peripheral reels in each of the reel positions 84. The display 64 may be LCD, OLED, or other suitable display. The center portion of the display 64 may be a transparent glass window 86 to protect the center display 62 and to provide a planar surface.

In another embodiment, during a primary game, the windows 82 displayed on the front screen 66 show at least three vertically aligned symbols on each reel. During a secondary game, the front screen 66 is controlled to display a window around each individual symbol so each symbol can be depicted as an independent reel that spins independently of all other reels. In the example of FIG. 9, the windows 82 would be segmented to show nine independent reels.

A similar change in animated windows may be performed if the display for the peripheral reels extended in front of the center reels display and displayed a center window through which the set back center reels display was viewed. The peripheral reels display could display windows to show each reel in the center display as having three or more vertical symbols. In a bonus game, the peripheral reel display can display windows that segment the center reels into nine or more independently driven center reels.

Figure 10:
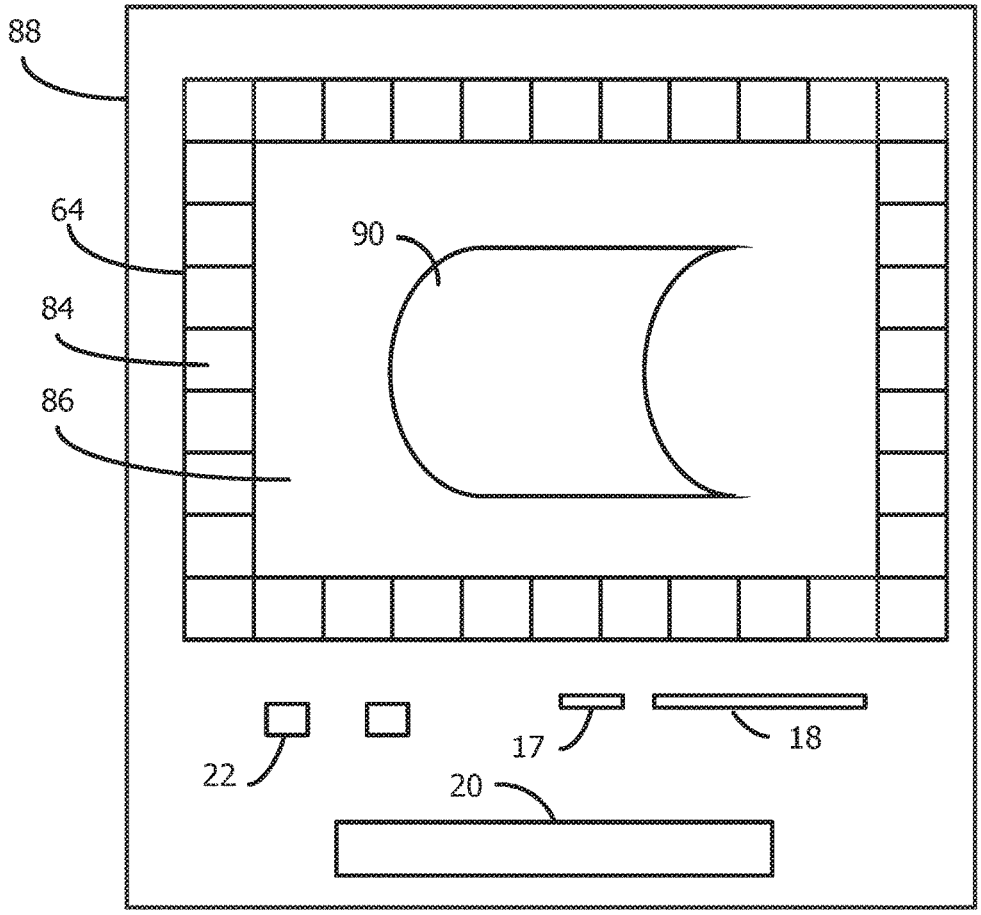
FIG. 10 illustrates how the center reels may be displayed on a separate curved screen which is viewed through a transparent window of the flat screen displaying the peripheral reels.

FIG. 10 illustrates another embodiment of a gaming machine 88 that displays the center reels on a separate curved screen 90 which is viewed through a transparent window 86 of the flat peripheral reel display 64. The curved screen 90 may be a flexible OLED or LCD screen that displays the center reel animation. This gives a 3-dimensional depiction of mechanical reels. The curved screen 90 is set back to emulate the position of actual reels in a conventional stepper machine. The transparent window 86 of the peripheral reel display 64 protects the curved screen 90.

Figure 11:
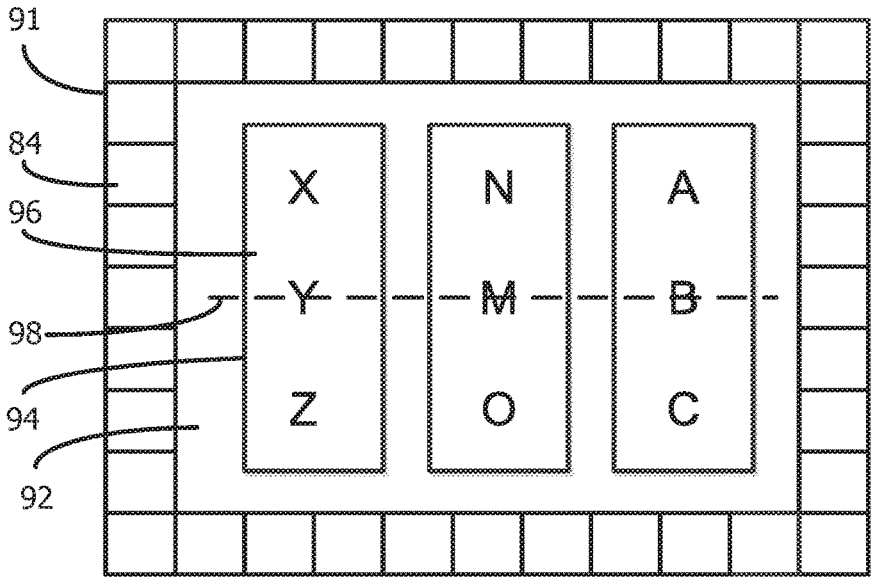
FIG. 11 illustrates an embodiment where the flat screen that displays the peripheral reels has a separate window for each center reel image, and where the center reels are displayed on a separate display screen that is set back to give the illusion of mechanical reels.

FIG. 11 illustrates an embodiment where the peripheral reel display 91 also displays an opaque portion 92 surrounding transparent windows 94 ("off" pixels) for viewing a second display 96 that is set back and displays the center reels. The set-back gives the illusion that the displayed center reels are motor driven reels. The display 91 may also animate any pay lines 98 across the center reels.

An autostereoscoptic display may also be used for the center reels to provide a 3-dimensional effect.

Other video systems involving two separate displays, where the center reels display is set back from the peripheral reel display, may be used to emulate mechanical center reels. The various features in the embodiments may be combined in any suitable manner.

The peripheral (secondary game) reels do not need to completely surround the center (primary game) reels. For example, the peripheral reels may just be provided along the top and sides of the center reels to partially surround the center reels. This allows other information to be presented below the center reels.

Any symbols can be displayed on the peripheral reels to carry out any secondary game. The peripheral reels may include symbols that grant a special bonus game that is carried out by the center reels.

The term gaming machine or gaming device also applies to home computers, PDAs, cell phones, and other computer devices that carry out the game. The game may be carried out on a stand-alone machine, or on a machine connected to a server, or may be played on-line with a home computer connected to a server via the Internet, or may be played on a smartphone or tablet via the Internet, or by other processing devices.

The term "random" as used herein includes both pseudo-random and purely random.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A gaming device comprising:

a first display comprising one of a first display screen for depicting motor driven reels or a physical set of motor driven reels, the first display depicting an M×N array of symbols, where M and N are greater than one, wherein an array size of the first display is fixed;

one or more second displays, separate from the first display, for displaying a set of secondary reels that surrounds the first display on at least three sides of the first display, the first display being set back into the gaming device, relative to the one or more second displays, to create a depth effect for the first display;

at least one computer programmed to carry out the following steps:

spinning and randomly stopping the set of depicted motor driven reels or the physical motor driven reels in the first display to play a primary game; and spinning and randomly stopping the set of secondary reels, to randomly display peripheral symbols, to play a secondary game, wherein the peripheral symbols comprise scatter symbols that are not combined with any symbols on the set of depicted motor driven reels or the physical motor driven reels in the first display.

2. The device of claim 1 wherein the scatter symbols displayed on the secondary reels in the secondary game are combinable only with each other to form winning symbol combinations of the scatter symbols in the secondary game.

3. The device of claim 1 wherein the peripheral symbols also include symbols identifying a monetary value.

4. The device of claim 1 wherein the secondary game includes peripheral symbols that award a bonus game that is played on the first display.

5. The device of claim 1 wherein the processing system is further programmed to carry out the steps of:

determining any winning symbol combinations in the M×N array of symbols;

detecting that there is a trigger condition for playing the secondary game, the trigger condition being based on the display of one or more of the at least one trigger symbol;

determining any winning symbol combinations by the scatter symbols displayed on the secondary reels or any winning symbol; and granting the player an award for any winning symbol combinations in the M×N array of symbols and a bonus award for any winning symbol combinations or winning symbol displayed by only the peripheral symbols displayed on the secondary reels.

6. The device of claim 1 wherein the secondary reels completely surround the first display.

7. The device of claim 1 wherein the first display comprises the set of motor driven reels.

8. The device of claim 1 wherein the first display comprises a video screen depicting motor driven reels.

9. The device of claim 8 wherein the first display comprises at least two flat screens, wherein one of the flat screens is in front of another of the flat screens to create a depth effect of the depicted motor driven reels.

10. The device of claim 8 wherein the first display is curved in an arc to emulate physical reels.

11. The device of claim 8 wherein the first display is a flat screen set back from the one or more secondary displays to create a depth effect for the first display.

* * * * *